United States Patent [19]

Liu

[11] Patent Number: 4,830,626

[45] Date of Patent: May 16, 1989

[54] CHRISTMAS-TREE SECURABLE EXTENSION CORD

[76] Inventor: Tzu-Chen Liu, P.O. Box 36-738, Taipei, Taiwan

[21] Appl. No.: 228,323

[22] Filed: Jul. 27, 1988

[51] Int. Cl.[4] ..... H01R 23/02

[52] U.S. Cl. ..... 439/425; 439/650

[58] Field of Search ..... 439/574, 575, 650, 686, 439/690, 389, 391, 425, 426; 248/231

[56] References Cited

U.S. PATENT DOCUMENTS

| | | | |
|---|---|---|---|
| 2,248,675 | 7/1941 | Huppert | 439/650 |
| 3,019,357 | 1/1962 | Zaffina | 439/650 |
| 3,848,220 | 11/1974 | Krantz | 439/650 |
| 3,860,739 | 1/1975 | Kloth et al. | 439/391 |
| 3,951,502 | 4/1976 | Bromberg | 439/650 |
| 4,274,696 | 6/1981 | Long et al. | 439/650 |
| 4,678,257 | 7/1987 | Ahroni | 439/686 |

*Primary Examiner*—Gary F. Paumen

[57] ABSTRACT

An extension cord includes: an extension cord having a plurality of loops formed thereon; and a plurality of sockets each connected with a loop of the cord and each socket having fasteners for securing the socket on a Christmas tree so that the extension cord can be concealedly mounted on a Christmas tree for further connecting plural lighting-bulb sets in the sockets for better decorative effect.

10 Claims, 3 Drawing Sheets

CHRISTMAS-TREE SECURABLE EXTENSION CORD

BACKGROUND OF THE INVENTION

Cox et al. disclosed a fiber optics illumination system in their U.S. Pat. No. 3,564,233 for a Christmas tree employing a light source located at the base of the tree to illuminate the optical fibers and a plurality of ornamental shapes distributed about the tree. Such a device may only be utilized for a small Christmas tree because the ornament 11 terminated on each fiber end may only illuminate a weak light through such a fine fiber.

In building a gigantic Christmas tree, plural extension cords should be provided, each cord having a socket for connecting a lighting set containing a plurality of decorative bulbs thereon, thereby causing the following drawbacks:

1. If the so many extension cords are electrically connected to a common power source, so many plugs of the extension cords commonly plugged in the sockets of the power source may easily cause electric danger when poorly connected.

2. The many extension cords for lighting sets or strings are each connected to the common power source to waste cord material.

3. Once an extension cord is tied on a Christmas tree, the tied cord is folded or twisted to be easily broken to cause electric danger.

4. If so many lighting sets are connected to a common receptacle of power source, a plurality of "add-on" plugs should be provided for such power connection, thereby being easily released from the receptacle.

5. So many extension cords, if not tied on the tree, may be tangled with one another or may influence their esthetic decorative effect.

The present inventor has found the drawbacks of a conventional cord as used for Christmas tree and invented the present extension cord securable on a Christmas tree.

SUMMARY OF THE INVENTION

The object of the present invention is to provide an extension cord including: a two-conductor extension cord having a plurality of rectangular loops formed thereon; and a plurality of socket means each electrically connected with each rectangular loop of the cord, each socket means having two fasteners, so that the socket means can be firmly secured on a Christmas tree by tying each fastener on the tree trunk or branch.

DETAILED DESCRIPTION

Figure 1:
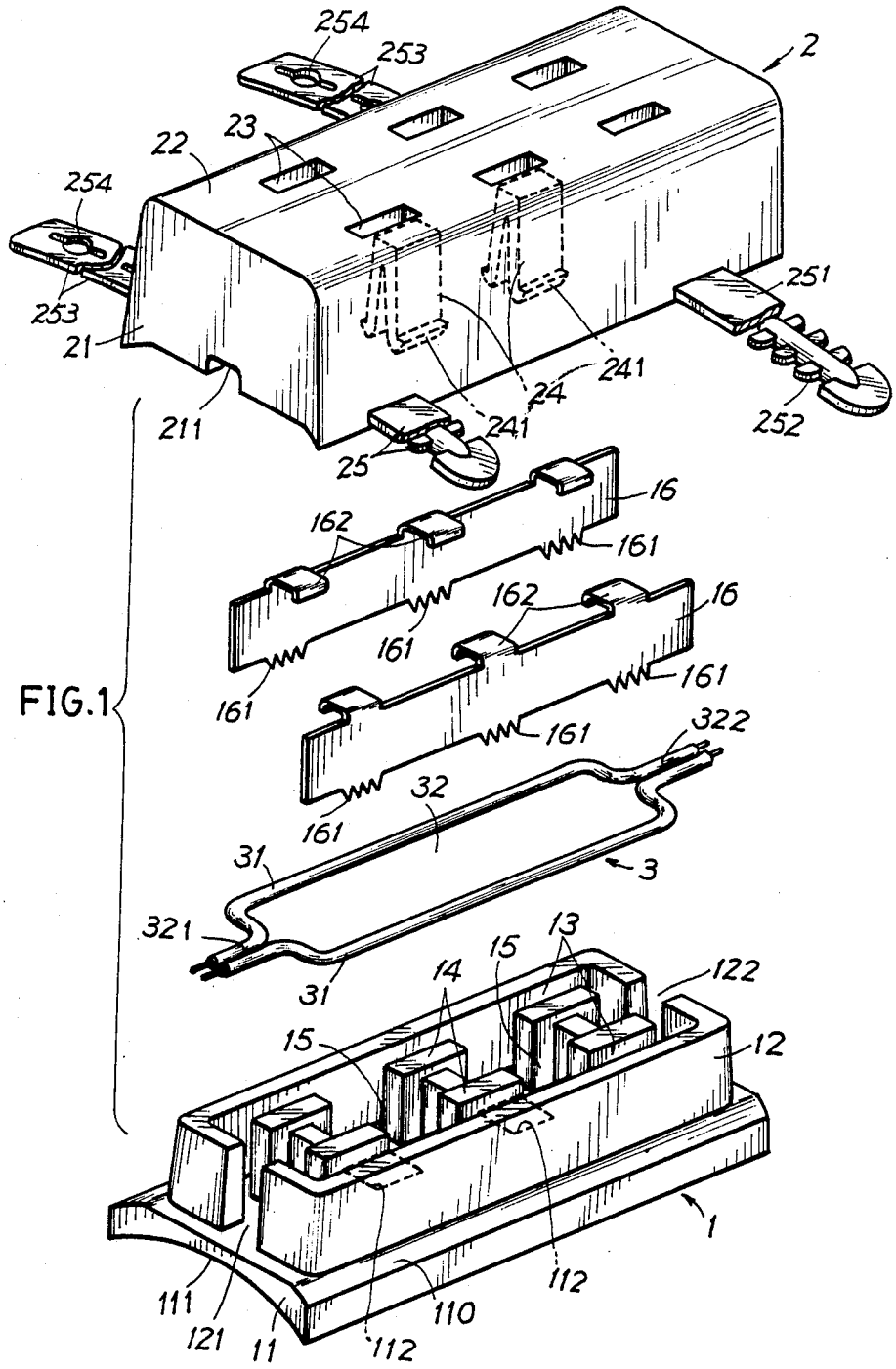
FIG. 1 is a perspective view showing all elements of the present invention.
Figure 2:
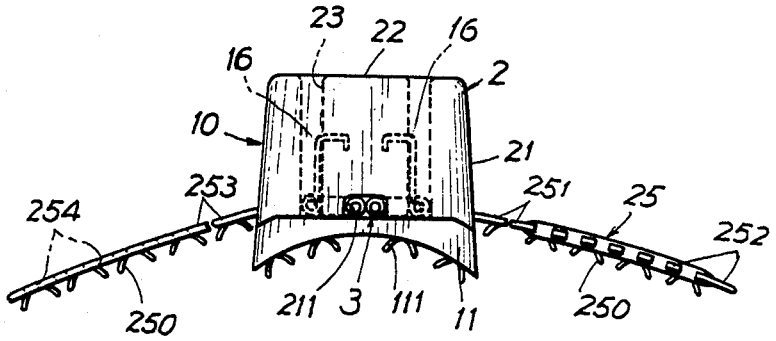
FIG. 2 is a front view of the present invention when assembled.
Figure 3:
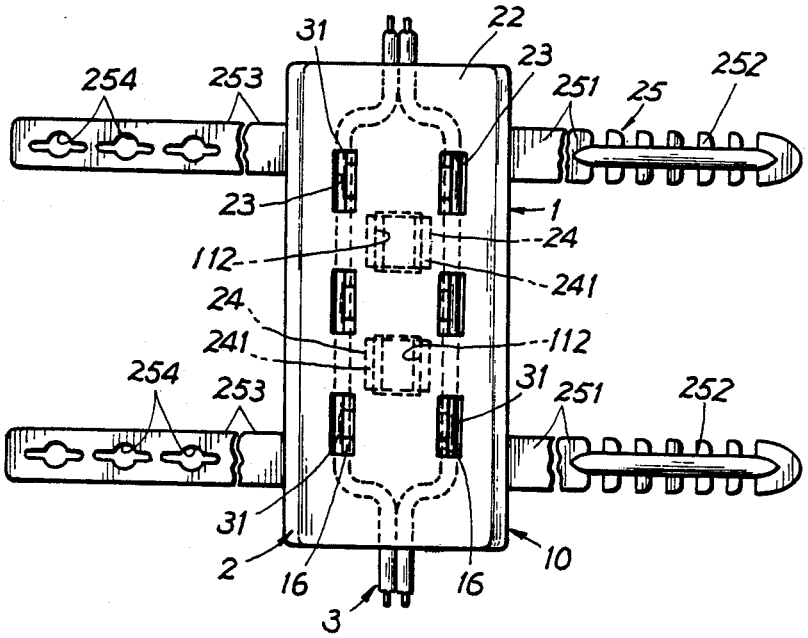
FIG. 3 is a side view of the present invention.

As shown in FIGS. 1–4, the present invention comprises: a two-conductor extension cord 3 and a plurality of socket means 10 connected on the cord 3.

Each socket means 10 includes: a base portion 1 generally formed as a rectangular shape and an upper cover 2 combined with the base portion 1 to clamp a rectangular loop 32 of the extension cord 3 therein.

The base portion 1 includes: a bottom plate 11 having its cross section formed as an arcuate shape and having anti-slipping or corrugated surface or felt 111 formed on a bottom surface under the plate 11, a side rectangular extension 12 protruding upwardly from the bottom plate 11 having a front opening 121 and a rear opening 122 respectively formed on two short transverse sides of the extension 12, a central extension 14 protruding upwardly from the bottom plate 11 defining a general rectangular slot 13 between the central extension 14 and the side extension 12, two sockets 15 recessed in the central extension 14 to communicate with two notches 112 recessed in the bottom plate 11, and two electric conductive plates 16 respectively embedded in two longitudinal slots within the rectangular slot 13 between the central extension 14 and the side extension 12.

Figure 4:
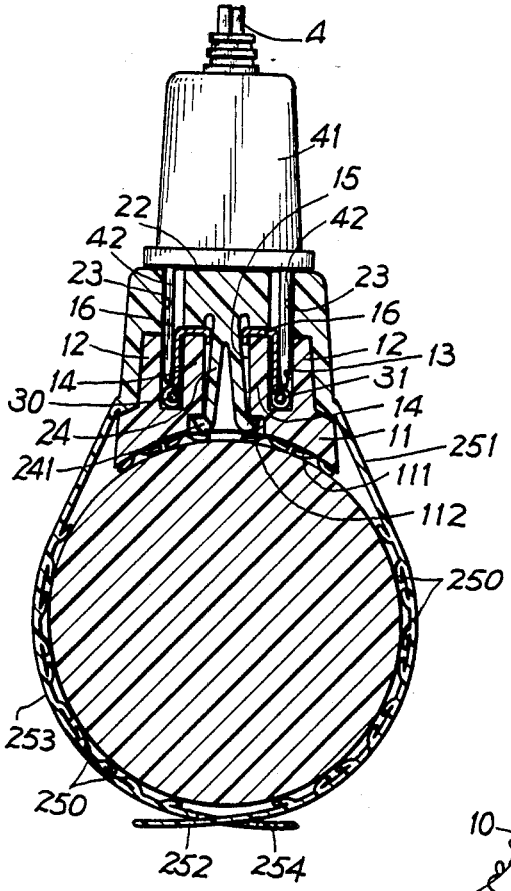
FIG. 4 is a sectional illustration of the present invention when secured on a tree trunk.

There is a rectangular margin portion 110 between an outermost edge of the bottom plate 11 and the side extension 12 to engageably seat a lower periphery of the upper cover 2. The central extension 14 may be formed as an U shape of its cross section as shown in FIGS. 1 and 4 saving plastic material. The conductive plate 16 includes a plurality of acute teeth or needle 161 formed on its bottom edge for poking into an insulator sheathed copper conductor 30 within a cord 31, and a plurality of bent portion 162 formed on an upper portion of the plate 16 to be crimped or fixed on a central extension 14.

The upper cover 2 includes: a rectangular side wall 21 circumferentially disposing around an upper plate 22, the upper plate 22 having a plurality of pairs of pin slots 23 adapted for inserting the pins 42 of a plug 41 of a lighting-bulb set 4 hanged on a Christmas tree 5, two locking members 24 protruding downwardly from the upper plate 22 each having a hook portion 241 formed on a lower end of each member 24 engageable with each notch 112 recessed in the bottom plate 11, and at least two fasteners 25 each fastener 25 having an anti-slipping surface 250 formed on its bottom surface and having a right strip 251 formed with a plurality of cross bars 252 thereon and a left strip 253 formed with a plurality of slits 254 therein so that the cross bar 252 of the right strip 251 can be fastened in a slit 254 of the left strip 253 to secure the socket means 10 of this invention on a Christmas tree trunk 51 as shown in FIG. 4. The anti-slipping surfaces 250, 111 may help secure the socket means 10 on a Christmas tree 5. The fasteners 25 may be further modified by those skill in the art.

Figure 6:
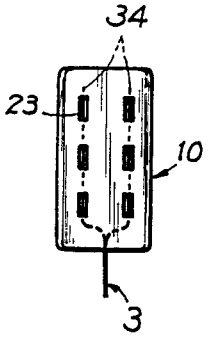
FIG. 6 is an illustration showing a last socket means formed on an end portion of an extension cord of the present invention.
Figure 5:
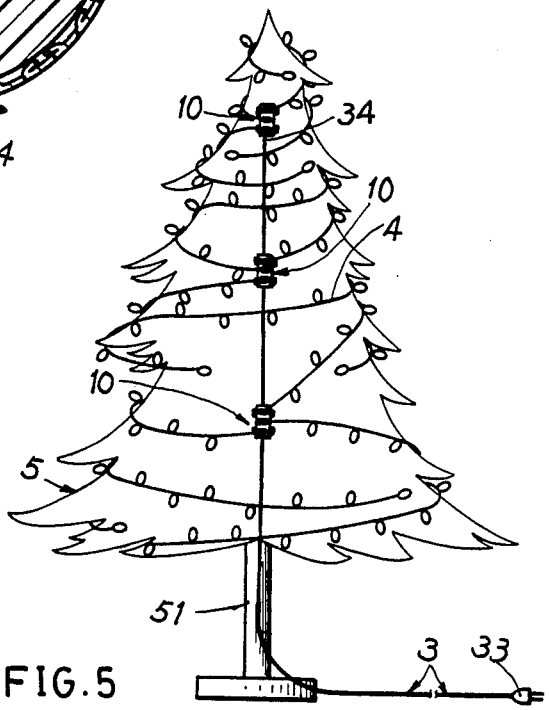
FIG. 5 is an illustration showing an application of the present invention on a Christmas tree.

The extension cord 3 includes a plurality of rectangular loops 32 formed on the cord having a plug 33 for connecting a power source, each rectangular loop 32 containing: an expansion end portion 321 by divergently splitting a two-conductor cord, each conductor 30 sheathed by a plastic insulator, into two separate plastic-sheathed cords 31 respectively engaged in a lower portion of the rectangular slot 13 defined between the side extension 12 and the central extension 14 of the base portion 12; and a contraction end portion 322 by convergently combining the two cords 31 to form a two-conductor cord. As shown in FIG. 5, the last socket means 10 terminated on the end of cord 3 may be such formed that the rectangular loop 32 is modified to be a Y-shaped bifurcated cord 34 to separate the two-conductor cord into two individual cords 31 as shown in FIG. 6.

In using the present invention as shown in FIG. 5, the extension cord 3 is clamped on a Christmas tree trunk 51 by fastening the fasteners 25 formed on each socket means 10 so that from each socket means 10 several lighting-bulb sets 4 can be connected thereto to have a wide-area decoration on the tree contour. The plug pins 42 are plugged into the slots 23 to contact the conductive plates 16 embedded in the two longitudinal slots in the rectangular slot 13.

The present invention has the following advantages in comparison with a conventional extension cord used for a Christmas tree;

1. The socket means 10 can be directly fastened on a tree by its own fasteners 25 for convenient decorative activities during a Christmas season.

2. The sockets 10 are directly connected on the loops 32 of the cord 3 without further connecting additional extension cords each cord having a socket thereon for saving wires and sockets.

3. The sockets 10 can be concealedly mounted in a shape of the Christmas tree by fastenning the stripes on the relevant tree branches or trunk, without influencing an overall esthetic decorative effect of the tree.

4. The lighting-bulb sets 4 can be homogeneously distributed on a tree by connecting each set 4 to its proximate socket 10 to prevent an electric accident due to poor power connection or overheating, because the sockets 10 of this invention can be preset safely, for example, two sockets 10 for a five-feet cord, 3 sockets for a seven-feet cord, four sockets for a nine-feet cord, respectively.

5. The upper cover 2 is pressed on the base portion 1 by engaging the locking members 24 to the notches 112 of the base portion to allow the cord 3 to be firmly secured in two opennings 211 formed in two transverse sides of the side wall 21 so that the socket 10 can be easily assembled. (Note: The conductive plate 16 is also firmly retained between the upper cover 2 and the lower base portion 1 as shown in FIG. 4).

I claim:

1. An extension cord securable on a Christmas tree comprising:

a two-conductor extension cord having one end formed with a plug for connecting a power source and having a plurality of rectangular loops formed thereon; and a plurality of socket means connected on the rectangular loops of said extension cord;

the improvement which comprises:

each said socket means including a base portion having a rectangular slot formed therein, two electrically conductive plates respectively embedded in two longitudinal slots within said rectangular slot;

each said rectangular loop of said extension cord having two cords split from said extension cord respectively engaged in a lower portion of said rectangular slot in said base portion, electrically contacting said two conductive plates embedded in said base portion;

an upper cover, having a plurality of pin slots formed therein for receiving a plug, combined with said base portion to form said socket means, each said pin slot being aligned with a said longitudinal slot in said base portion; and said upper cover having at least two fasteners, each fastener operatively clamping a Christmas tree trunk or branch for firmly securing each said socket means on a Christmas tree.

2. An extension cord according to claim 1, wherein said rectangular loop of said extension cord includes an expansion end portion by divergently splitting said two-conductor cord into two separate cords engageable with the two longitudinal slots in said base portion, and a contraction end portion by convergently combining the two separate cords to form said two-conductor cord.

3. An extension cord according to claim 1, wherein a final said socket means terminated on an outermost end of said extension cord includes a Y-shaped bifurcate cord by splitting the two-conductor cord into two separate cords engageable with the two longitudinal slots in said base portion.

4. An extension cord according to claim 1, wherein said base portion includes a side extension protruding upwardly from a bottom plate of said base portion proximate to an outermost edge of said bottom plate, a central extension protruding upwardly from a central portion of said bottom plate, a rectangular slot defined between said side extension and said central extension for inserting said rectangular loop of said extension cord in said rectangular slot, said rectangular slot including two longitudinal slots on its two longitudinal sides adapted for the insertion of mating plug pins inserted through the pin slots in said upper cover.

5. An extension cord according to claim 4, wherein said bottom plate of said base portion is formed with two recessed notches engageable with two hook portions of two locking members of the upper cover, so that said upper cover is combined to said base portion by poking said two locking members of said upper cover through two sockets formed in said central extension of said base portion to engage said bottom plate of said base portion.

6. An extension cord according to claim 4, wherein said bottom plate is formed as an arcuate shape and formed with an anti-slipping surface on a bottom surface thereof.

7. An extension cord according to claim 1, wherein each said conductive plate includes plural teeth formed on its lower edge poking into a sheathed said conductor of the said extension cord to electrically contact said conductor, and plural bent portions formed on an upper portion of each said conductive plate being crimped or fixed on said central extension so that each said conductive plate is firmly embedded in said base portion within a said longitudinal slot for electrically contacting a plug pin inserted into said socket means.

8. An extension cord according to claim 1, wherein each said fastener of said upper cover includes a right strip having a plurality of cross bars formed thereon, and a left strip having a plurality of slits formed therein, whereby upon an engagement of the cross bar into the slit, the right strip will be fastened to the left strip for securing said socket means on a Christmas tree.

9. An extension cord according to claim 8, wherein each said fastener is formed with an anti-slipping surface on a bottom surface thereof.

10. An extension cord according to claim 1, wherein said side extension of said base portion is formed with a front opening and a rear opening, and said upper cover is also formed with a front and rear opening on its side walls to allow the passing and fixation of said extension cord except said rectangular loop through all said openings.

* * * * *